US011832739B2

(12) United States Patent
Park

(10) Patent No.: US 11,832,739 B2
(45) Date of Patent: Dec. 5, 2023

(54) SHOWCASE WITH TWO-STORY STRUCTURE

(71) Applicant: TURBO KOREA Corporation, Gwangju (KR)

(72) Inventor: Chang Hun Park, Gwangju (KR)

(73) Assignee: Turbo Korea Corporation, Gwangju (KR)

( * ) Notice: Subject to any disclaimer, the term of this patent is extended or adjusted under 35 U.S.C. 154(b) by 0 days.

(21) Appl. No.: 17/890,811

(22) Filed: Aug. 18, 2022

(65) Prior Publication Data

US 2023/0276955 A1 Sep. 7, 2023

(30) Foreign Application Priority Data

Mar. 2, 2022 (KR) ..... 10-2022-0026837

(51) Int. Cl.
*A47F 3/04* (2006.01)

(52) U.S. Cl.
CPC ..... *A47F 3/0408* (2013.01); *A47F 3/043* (2013.01)

(58) Field of Classification Search
CPC ..... A47F 3/043; A47F 3/0408; A47F 3/063; F25D 17/04; F25D 17/06; F25D 17/08; F25D 23/021; F25D 23/026; F25D 23/061; F25D 23/069; F25D 25/025; F25D 2317/0664; F25D 2400/10
See application file for complete search history.

(56) References Cited

U.S. PATENT DOCUMENTS 2,693,089 A * 11/1954 Teeter ..... A47F 3/0443 62/253
5,168,719 A * 12/1992 Branz ..... F25D 17/065 62/256
6,109,051 A * 8/2000 Majordy ..... F25D 17/06 62/414
6,449,976 B1 * 9/2002 Chai ..... F25D 23/04 62/382
6,564,569 B1 * 5/2003 Havens ..... F25D 17/06 62/414
6,941,765 B2 * 9/2005 Sung ..... A47F 3/0408 62/298
2002/0059805 A1 * 5/2002 Lee ..... F25D 17/045 62/407

FOREIGN PATENT DOCUMENTS

KR 20-1997-0026797 U 7/1997
KR 10-2014-0132070 A 11/2014

* cited by examiner

*Primary Examiner* — Joseph F Trpisovsky
(74) *Attorney, Agent, or Firm* — Blank Rome LLP

(57) ABSTRACT

A showcase with a two-story structure includes a body having an upper story storage chamber with a top opening formed on top thereof and first cold air introduction holes formed on the side surfaces thereof and a lower story storage chamber separately disposed adjacent to the underside of the upper story storage chamber and with a front opening formed on front thereof and second cold air introduction holes formed on the side surfaces thereof; upper doors for opening and closing the top opening of the upper story storage chamber; and drawers for slidingly opening and closing the front opening of the lower story storage chamber.

8 Claims, 6 Drawing Sheets

SHOWCASE WITH TWO-STORY STRUCTURE

CROSS REFERENCE TO RELATED APPLICATION OF THE INVENTION

The present application claims the benefit of Korean Patent Application No. 10-2022-0026837 filed in the Korean Intellectual Property Office on Mar. 2, 2022, the entire contents of which are incorporated herein by reference.

BACKGROUND OF THE INVENTION

Field of the Invention

The present invention relates to a showcase with a two-story structure, and more specifically, to a showcase with a two-story structure that is capable of allowing an upper story storage chamber and a lower story storage chamber to be separately disposed therein.

Background of the Related Art

Generally, a refrigeration showcase is provided to store milk and meat easily spoiling at room temperature and all types of cold beverages, which are desirable to be kept cold, such as soda, ice creams, and the like, at low temperature, while allowing foods or products stored therein to be seen well to the outside, so that a customer's desired food or product is pre-chosen from the stored foods or products in the refrigeration showcase before opening the door of the showcase, and next, he or she picks up his or her desired food or product.

In specific, if the customer chooses his or her desired food or product after he or she has opened the door of the refrigeration showcase, the cold air in the refrigerator is exhausted to the outside so that it is hard to keep the interior of the refrigerator at a low temperature and power consumption is unnecessarily caused. To avoid such problems, accordingly, the refrigeration showcase is configured to allow the foods or products in the refrigerator to be pre-chosen by the customer before the door of the refrigerator is opened by him or her.

However, conventional refrigeration showcases do not have any structure in which up/down separated storage chambers have different temperature distributions from each other, thereby disadvantageously limiting the types of foods or products stored therein.

Further, in the case where the conventional refrigeration showcases have such separated storage chambers, they do not have any cold air circulation structure in which cold air is gently circulated, thereby causing the cold air to stay on the bottoms of the storage chambers. Accordingly, ice may be produced even under a small amount of moisture so that it has to be periodically removed inconveniently, and due to the production of the ice, it is hard to control cooling in the storage chambers and the number of foods or products stored in the storage chambers may be decreased.

SUMMARY OF THE INVENTION

Accordingly, the present invention has been made to solve the above-mentioned problems, and it is an object of the present invention to provide a showcase with a two-story structure that is capable of allowing an upper story storage chamber and a lower story storage chamber to be separately disposed therein, thereby sortedly storing a variety of foods or products having different storage characteristics from one another, providing many conveniences of use, and ensuring gentle cold air circulation.

To accomplish the above-mentioned objects, according to the present invention, there is provided a showcase with a two-story structure including: a body having an upper story storage chamber with a top opening formed on top thereof and first cold air introduction holes formed on the side surfaces thereof and a lower story storage chamber separately disposed adjacent to the underside of the upper story storage chamber and with a front opening formed on front thereof and second cold air introduction holes formed on the side surfaces thereof; upper doors for opening and closing the top opening of the upper story storage chamber; and drawers for slidingly opening and closing the front opening of the lower story storage chamber.

When viewed from the front of the showcase, the upper story storage chamber may be divided into a plurality of upper story sub-storage chambers by means of a first upper story fan case disposed between both transverse ends thereof, and the first upper story fan case may include a pair of first frames facingly located at left and right sides to form a flowing space therebetween, one or more first suction fans located in front and rear directions of the body on the lower portions of the first frames facing both left and right ends of the body and facing the end of the showcase body facing the first frame, and first exhaust holes piercedly formed on the upper portions of the first frames, respectively.

Each first exhaust hole may have the shape of a long hole extending in front and rear directions.

When viewed from the front of the showcase, the upper story sub-storage chambers may be dividedly disposed between the first upper story fan case and at least one of both left and right ends of the body, respectively, by means of second upper story fan cases, and each second upper story fan case may include a pair of second frames facingly located at left and right sides to form a flowing space therebetween, a plurality of second suction fans located in front and rear directions of the body on the lower portions of the second frames facing the first upper story fan case and facing the first frame, second exhaust holes piercedly formed on the upper portions of the second frames, respectively, and a first outlet formed at a position facing at least one of the second suction fans disposed in the front and rear directions on the lower portions of the second frames where no second suction fans are disposed.

When viewed from the front of the showcase, the lower story storage chamber may be divided into a plurality of lower story sub-storage chambers by means of a lower story fan case disposed between both transverse ends thereof, the lower story sub-storage chambers being open and closed by means of the drawers, respectively, and the lower story fan case may include a pair of third frames facingly located at left and right sides to form a flowing space therebetween, a pair of third suction fans facing the left and right sides of the body respectively and spaced apart from each other in front and rear directions respectively at the upper portions of the third frames facing both left and right ends of the body, and second outlets formed at the positions corresponding to the third suction fans on the third frames facing the third suction fans.

Rail members for guiding the movements of the drawers on both sides with the lower story fan case interposed therebetween are spaced apart.

The upper story storage chamber or one of the upper story sub-storage chambers may have an ice cream storage container frame disposed thereon to mount ice cream storage containers thereonto, and the ice cream storage container frame may have cold air guide holes formed at tops facing the first exhaust holes and the second exhaust holes to move the cold air to the top of the ice cream storage containers.

The lower story storage chamber may extend in left and right directions from one end of the upper story storage chamber, and the width of the upper story storage chamber may be larger than the width of the lower story storage chamber to allow a machine room to be located on a stepped space between the upper story storage chamber and the lower story storage chamber.

The upper story storage chamber may have cold air communication holes extending in front and rear directions from the bottom thereof to thus communicate with the lower story storage chamber, and the cold air communication holes are formed on the positions adjacent to the second frames of the second upper story fan cases.

BRIEF DESCRIPTION OF THE DRAWINGS

The above and other objects, features and advantages of the present invention will be apparent from the following detailed description of the embodiments of the invention in conjunction with the accompanying drawings, in which.

DETAILED DESCRIPTION OF THE EMBODIMENTS

Hereinafter, the present invention will be described in detail with reference to the attached drawings.

Figure 1:
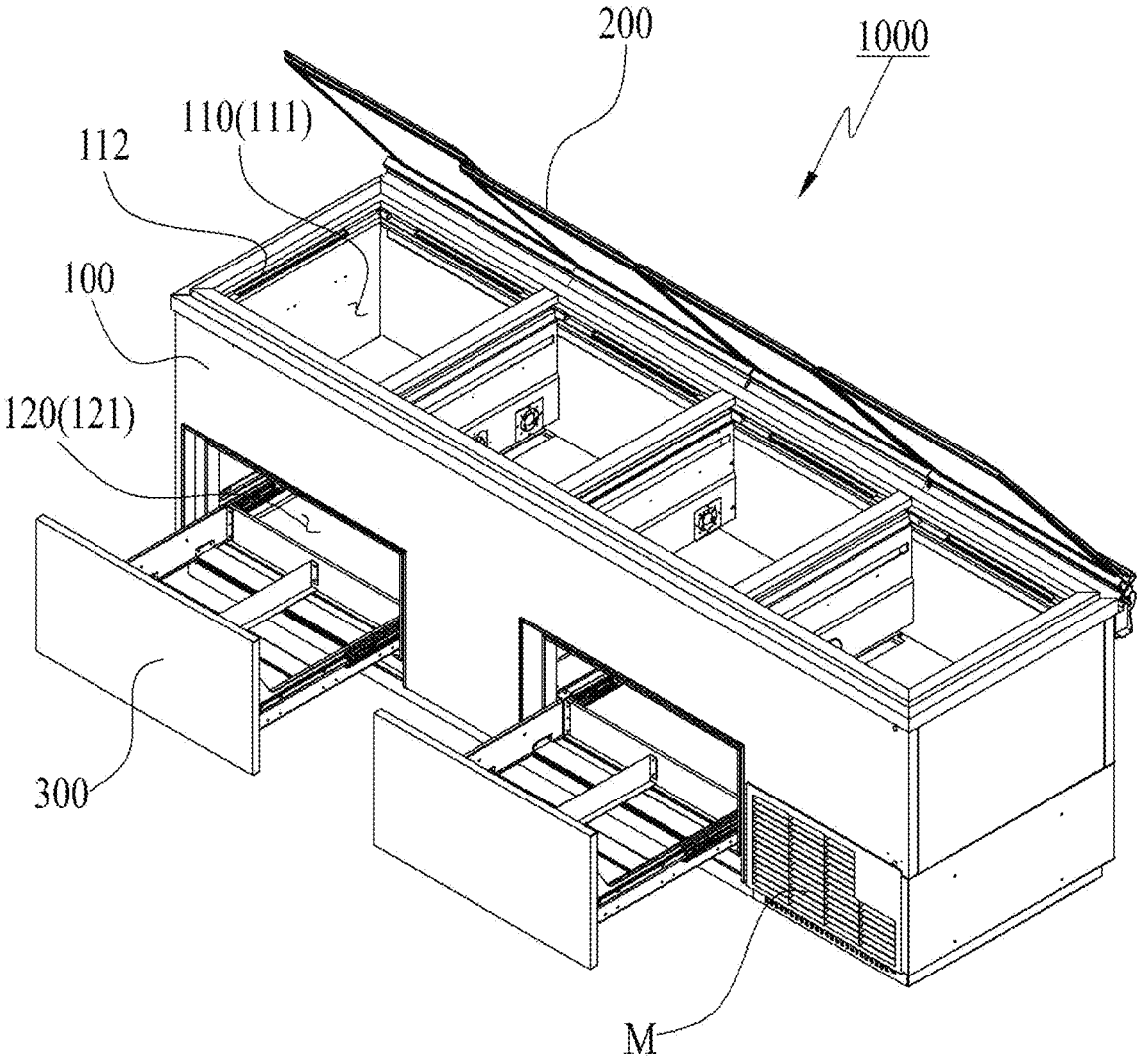
FIG. 1 is a perspective view showing a showcase with a two-story structure according to the present invention.

As shown in FIG. 1, a showcase 1000 with a two-story structure according to the present invention includes: a body 100 having an upper story storage chamber 110 having a top opening 111 formed on top thereof and first cold air introduction holes 112 formed on the side surfaces thereof and a lower story storage chamber 120 separately disposed adjacent to the underside of the upper story storage chamber 110 and having a front opening 121 formed on the front thereof and second cold air introduction holes 122 (See FIG. 4) formed on the side surfaces thereof; upper doors 200 for opening and closing the top opening 111 of the upper story storage chamber 110; and drawers 300 for slidingly opening and closing the front opening 121 of the lower story storage chamber 120.

Like this, the showcase 1000 with a two-story structure according to the present invention is configured to have the upper story storage chamber 110 and the lower story storage chamber 120 separated up and down to thus have different temperatures distributed thereto, thereby sortedly storing a variety of foods or products with different storage characteristics from one another therein.

Further, the front opening 121 of the lower story storage chamber 120 is open and closed by means of the drawers 300, thereby advantageously ensuring conveniences of use.

The upper doors 200 for opening and closing the top opening 111 are mounted on one side top end of the upper story storage chamber 110 by means of hinges, so that they can perform the opening and closing operations more easily.

Of course, the upper doors 200 may slide in front and rear directions or left and right directions to thus open and close the top opening 111.

As shown in FIGS. 2 to 5, when viewed from the front of the showcase 1000, the upper story storage chamber 110 is divided into a plurality of upper story sub-storage chambers 110*a* by means of a first upper story fan case 400 disposed between both transverse ends thereof.

In specific, when viewed from the front section of the showcase 1000, the first upper story fan case 400 includes a pair of first frames 420 and 430 facingly located at left and right sides to form a flowing space 410 therebetween, one or more first suction fans 440 located in front and rear directions of the body 100 on the lower portions of the first frames 420 and 430 facing both left and right ends of the body 100 and facing the end of the showcase body 100 facing the first frames 420 and 430, and first exhaust holes 450 piercedly formed on the upper portions of the first frames 420 and 430, respectively.

In this case, desirably, the first frames 420 and 430 disposed to face each other are bent inwardly from the bottoms thereof to seal the bottom of the flowing space 410.

Under the above-mentioned configuration, cold air, which is blown to the upper story storage chamber 110 via an evaporator (not shown) and the first cold air introduction holes 112 sequentially, moves to the bottom of the upper story storage chamber 110, and is then introduced into the flowing space 410 of the first upper story fan case 400 through the first suction fans 440, while not staying on the bottom of the upper story storage chamber 110. After that, the cold air moves upward and is then exhausted to the upper space of the upper story storage chamber 110 through the first exhaust holes 450, so that a cold air circulation structure is provided, thereby preventing ice in the upper story storage chamber 110 from being produced to keep a constant refrigeration temperature and to allow cooling for the foods or products stored in the upper story storage chamber 110 to be easily controlled.

That is, the cold air is gently circulated, without staying on the bottom of the upper story storage chamber 110, thereby preventing the formation of ice therein.

Accordingly, there is no need to inconveniently remove ice from the upper story storage chamber 110, it is easy to perform cooling control for the foods or products stored therein, and the foods or products can be easily accommodated therein.

Further, when viewed from the transverse section of the first upper story fan case 400, a width between the first frames 420 and 430 becomes gradually decreased in a direction from the first suction fans 440 to the upper portions of the first frames 420 and 430, and accordingly, the cold air introduced into the flowing space 410 through the first suction fans 440 becomes fast in a flow rate thereof, while moving upward, so that the cold air exhausted through the first exhaust holes 450 can move to a longer distance.

Moreover, each first exhaust hole 450 has the shape of a long hole extending in front and rear directions to allow the cold air moving from the flowing space 410 to be exhausted to the upper story storage chamber 110 uniformly in the front and rear directions of the upper story storage chamber 110.

When viewed from the front of the showcase 1000, second upper story fan cases 500 are disposed between the first upper story fan case 400 and at least one of both left and right ends of the body 100, respectively, to additionally divide the upper story sub-storage chambers 110*a*, so that the foods or products can be separately stored according to their types.

Figure 3:
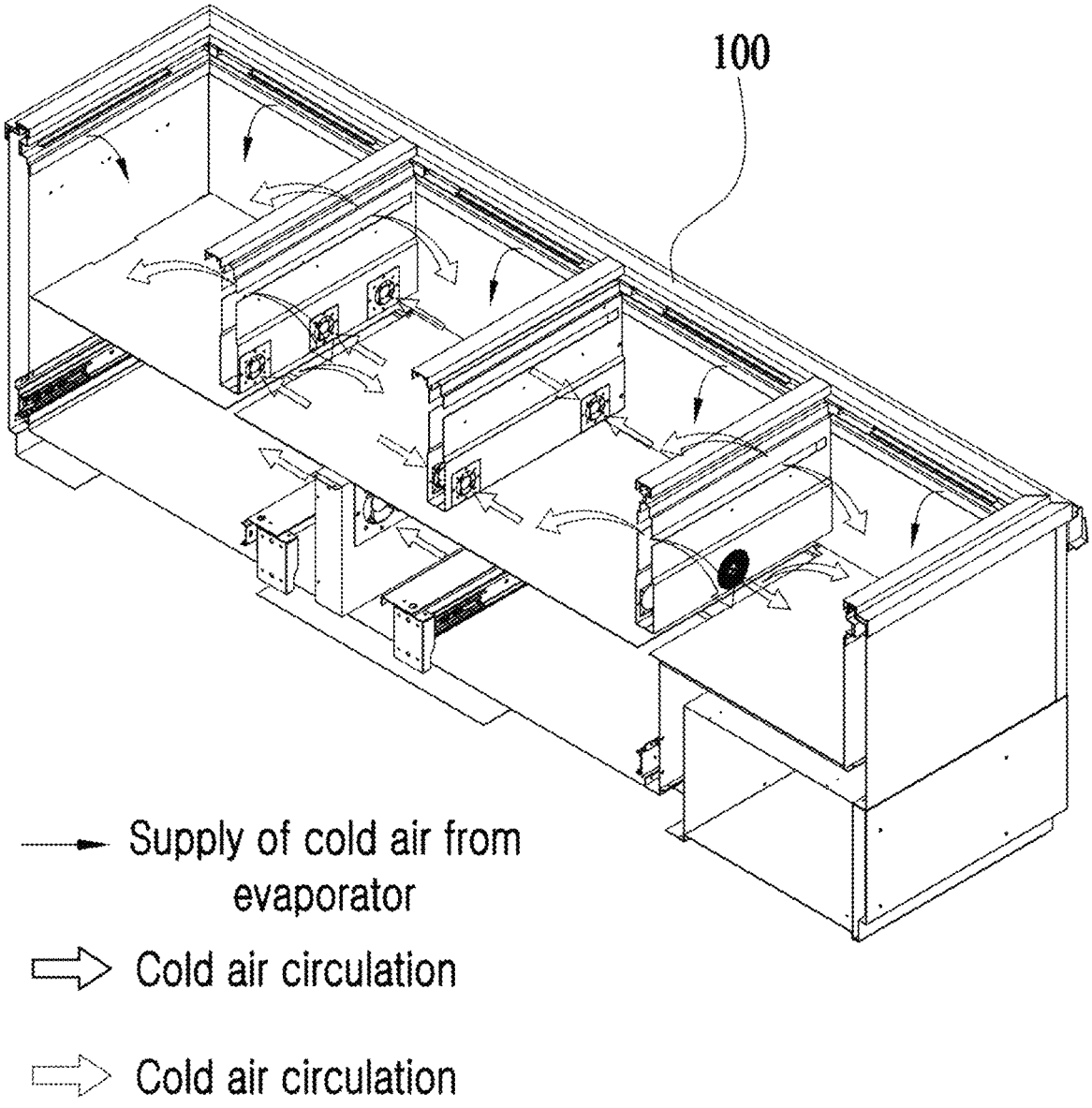
FIG. 3 is a sectional perspective view showing a cold air circulation structure of FIG. 2.
Figure 5:
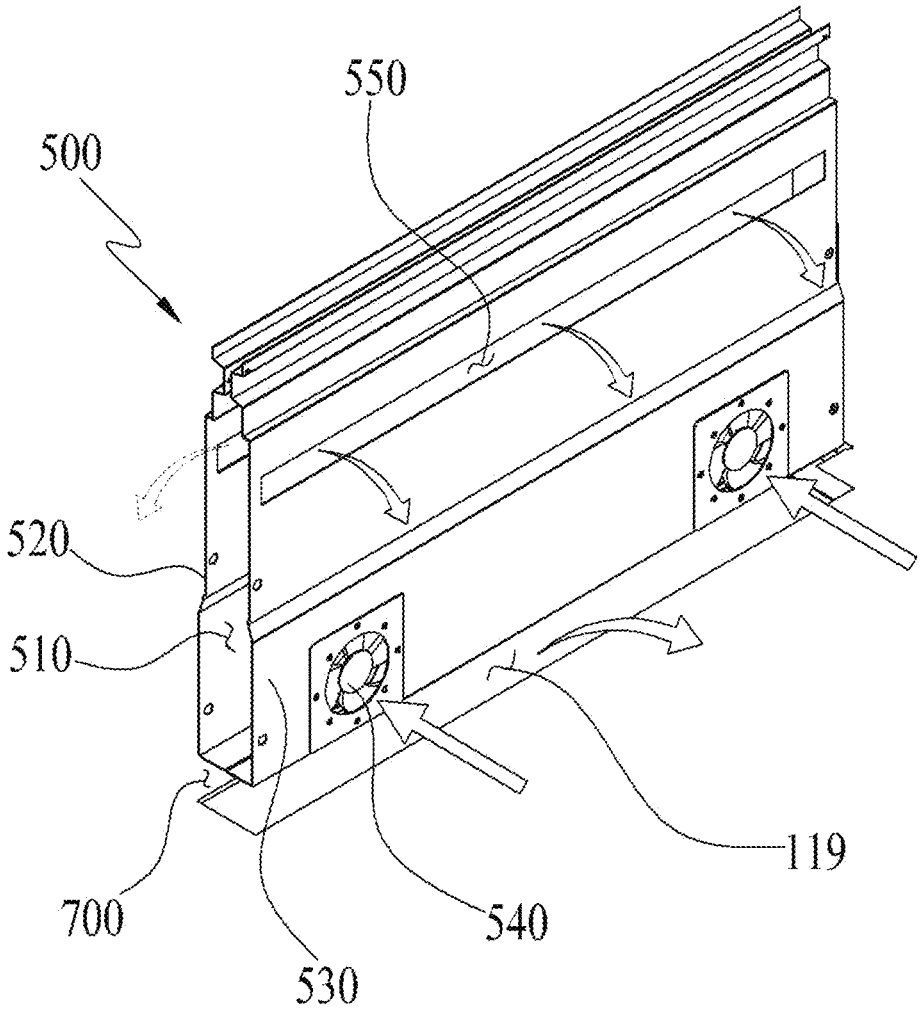
FIG. 5 is a sectional perspective view showing a specific configuration and a cold air circulation structure of a second upper story fan case of FIG. 2.

In this case, as shown in FIGS. 3 and 5, each second upper story fan case 500 includes a pair of second frames 520 and 530 facingly located at left and right sides to form a flowing space 510 therebetween, a plurality of second suction fans 540 located in front and rear directions of the body 100 on the lower portions of the second frames 520 and 530 facing the first upper story fan case 400 and facing the first frames 420 or 430, and second exhaust holes 550 piercedly formed on the upper portions of the second frames 520 and 530, respectively.

Under the above-mentioned configuration, cold air, which exists on the bottom of a first upper story storage chamber 115 between the first upper story fan case 400 and the second upper story fan case 500, is sucked to both of the first upper story fan case 400 and the second upper story fan case 500, and the sucked cold air moves up through the flowing spaces 410 and 510 and is then exhausted through both of the first exhaust holes 450 and the second exhaust holes 550 to the first upper story storage chamber 115, so that a cold air circulation structure is provided.

Further, on the lower portions of the second frames 520 and 530 where the second suction fans 540 are not disposed is formed a first outlet 560 at a position facing at least one of the second suction fans 540 disposed in the front and rear directions.

Accordingly, the formation of the ice caused by the accumulation of the cold air onto the bottoms of the first upper story storage chambers 115 can be more reliably prevented.

Figure 4:
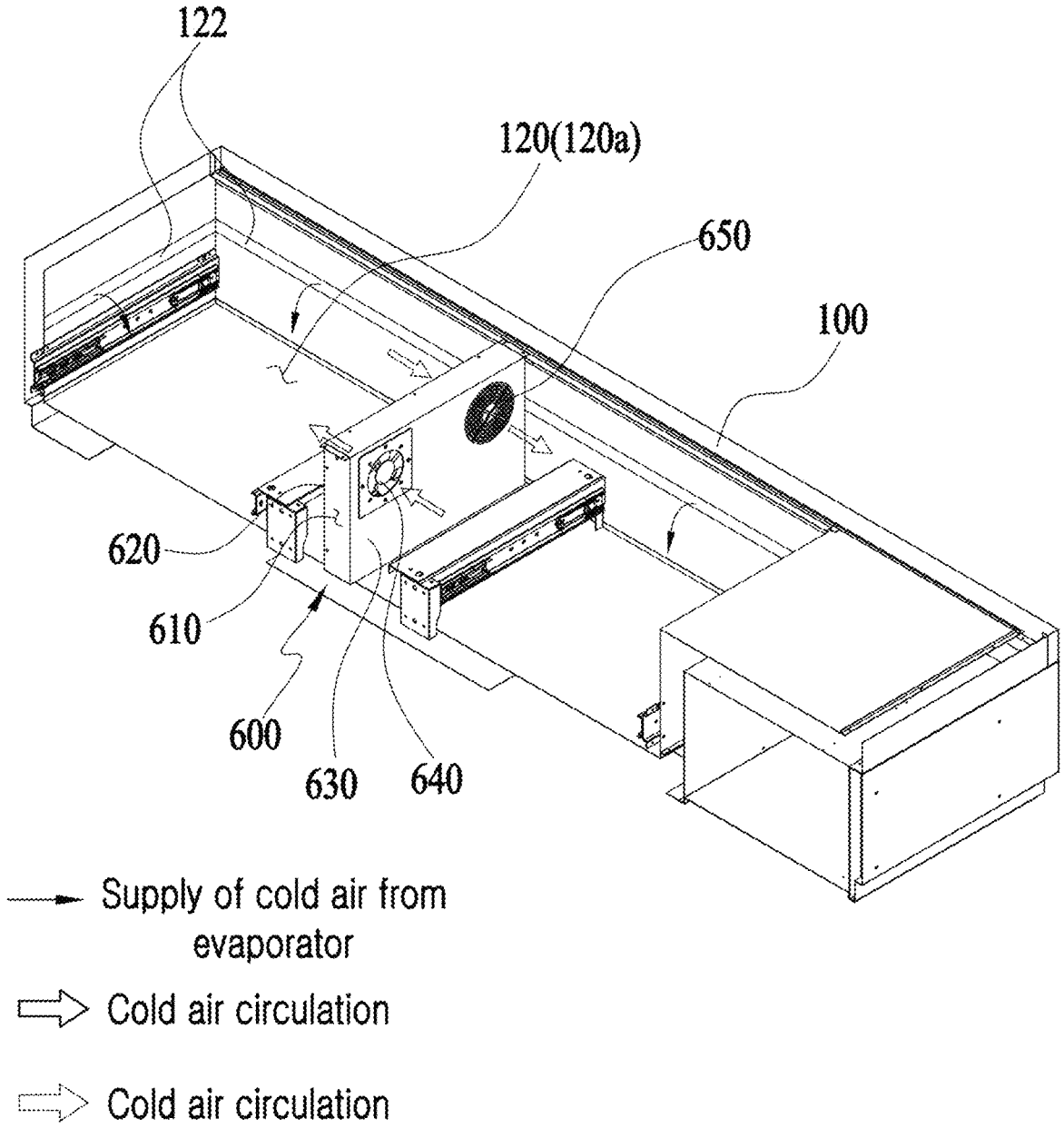
FIG. 4 is a sectional perspective view showing a configuration and a cold air circulation structure around a lower story storage chamber of FIG. 2.

Further, as shown in FIGS. 3 and 4, the cold air sucked from the bottoms of the first upper story storage chambers 115 moves up in the flowing spaces 510, is exhausted through the second exhaust holes 550 to second upper story storage chambers 116 formed between the second upper story fan cases 500 and both inner surfaces of the upper story storage chamber 110, respectively, and is then exhausted through the first outlets 560 to the second upper story storage chambers 116, thereby providing the cold air circulation structure where the cold air is not accumulated on the bottoms.

That is, the cold air exhausted through the first outlets 560 by means of the second suction fans 540 moves to both inner surfaces of the upper story storage chamber 110 at a fast speed and thus lifts up the cold air moving down from the second exhaust holes 550 and the first cold air introduction holes 112, thereby preventing ice from being generated due to the cold air accumulated on the bottom of the upper story storage chamber 110.

In this case, the first outlets 560 are formed correspondingly to the inner side second suction fans 540, thereby desirably achieving more uniform cold air circulation.

Further, as shown in FIG. 4, when viewed from the front of the showcase 1000, the lower story storage chamber 120 is divided into a plurality of lower story sub-storage chambers 120*a* by means of a lower story fan case 600 disposed between both transverse ends thereof, and the lower story sub-storage chambers 120*a* are open and closed by means of the drawers 300, respectively. The lower story fan case 600 includes a pair of third frames 620 and 630 facingly located at left and right sides to form a flowing space 610 therebetween, a pair of third suction fans 640 facing the left and right sides of the body 100 respectively and spaced apart from each other in front and rear directions respectively at the upper portions of the third frames 620 and 630 facing both left and right ends of the body 100, and second outlets 650 formed at the positions corresponding to the third suction fans 640 on the third frames 620 and 630 facing the third suction fans 640.

Through the lower story fan case 600, the lower story storage chamber 120 is divided into the two lower story sub-storage chambers 120*a*, and through the third suction fans 640 spaced apart from each other in the front and rear directions, cold air circulation between the two lower story sub-storage chambers 120*a* is performed, so that the cold air is not accumulated on the bottom of the lower story storage chamber 120, thereby preventing the formation of ice.

The heights of the third suction fans 640 of the lower story storage chamber 120 are higher than those of the drawers 300, so that the cold air is uniformly distributed to the drawers 300, while being circuited, thereby enabling uniform cooling to be applied to the surfaces of the foods or products stored in the lower story storage chamber 120.

Further, rail members 180 for guiding the movements of the drawers 300 on both sides with the lower story fan case 600 interposed therebetween are spaced apart, and the rail members 180 extend in front and rear directions to move the drawers 300 forward and backward.

Figure 6:
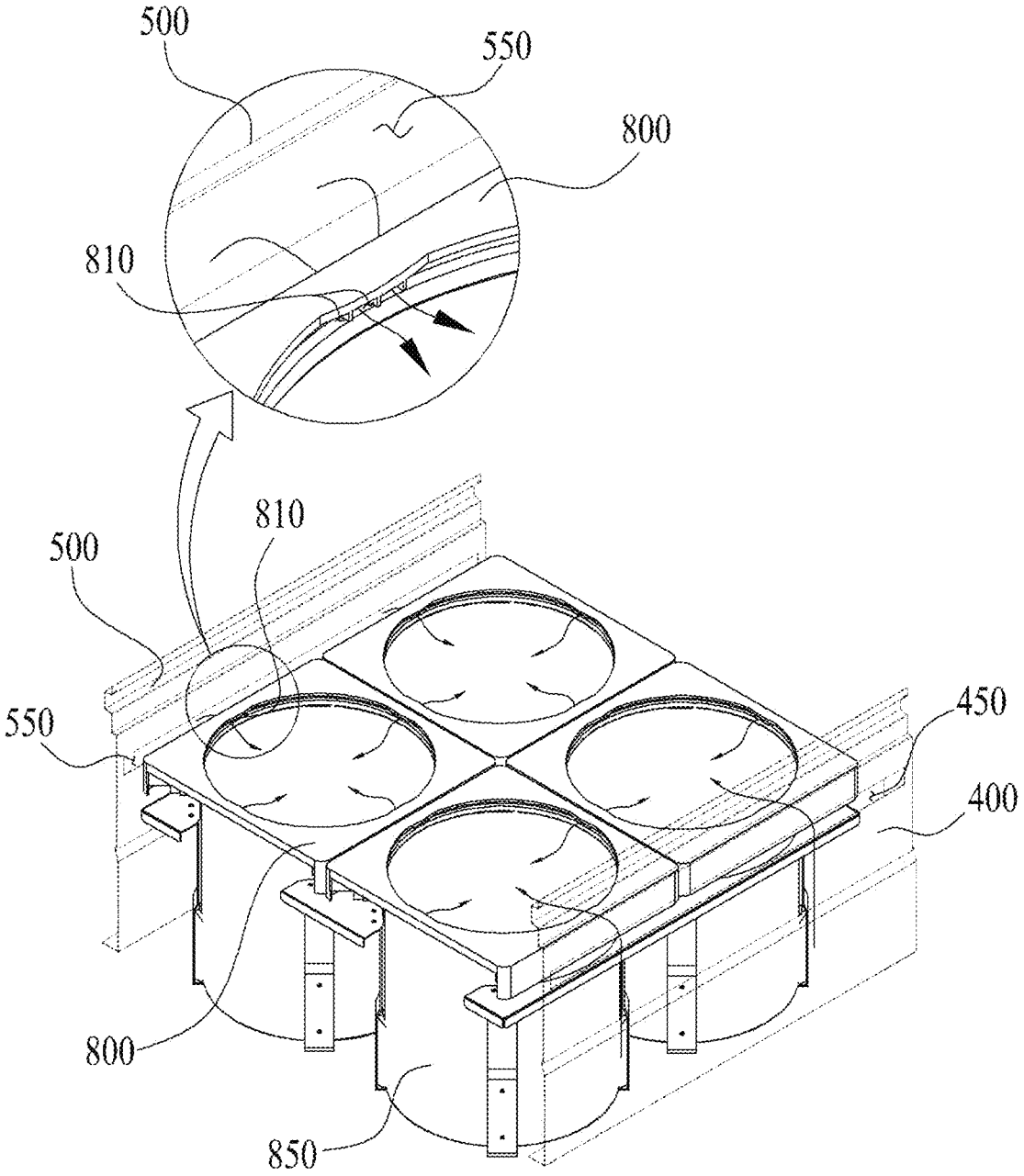
FIG. 6 is an enlarged perspective view showing a configuration in which ice cream storage containers are stored in a first upper story storage chamber of FIG. 2.

Further, as shown in FIG. 6, an ice cream storage container frame 800 is disposed on the upper story storage chamber 110 or one of the upper story sub-storage chambers 110*a* to mount ice cream storage containers 850 thereonto, and cold air guide holes 810 are formed at tops of the ice cream storage container frame 800 facing the first exhaust holes 450 and the second exhaust holes 550 to move the cold air to the top end peripheries of the ice cream storage containers 850.

Under the above-mentioned configuration, the cold air exhausted from the first exhaust holes 450 and the second exhaust holes 550 moves from the top ends of the ice cream storage container frame 800 to ice cream through the cold air guide holes 810, thereby keeping the cold air on the surface of the ice cream reliably.

Figure 2:
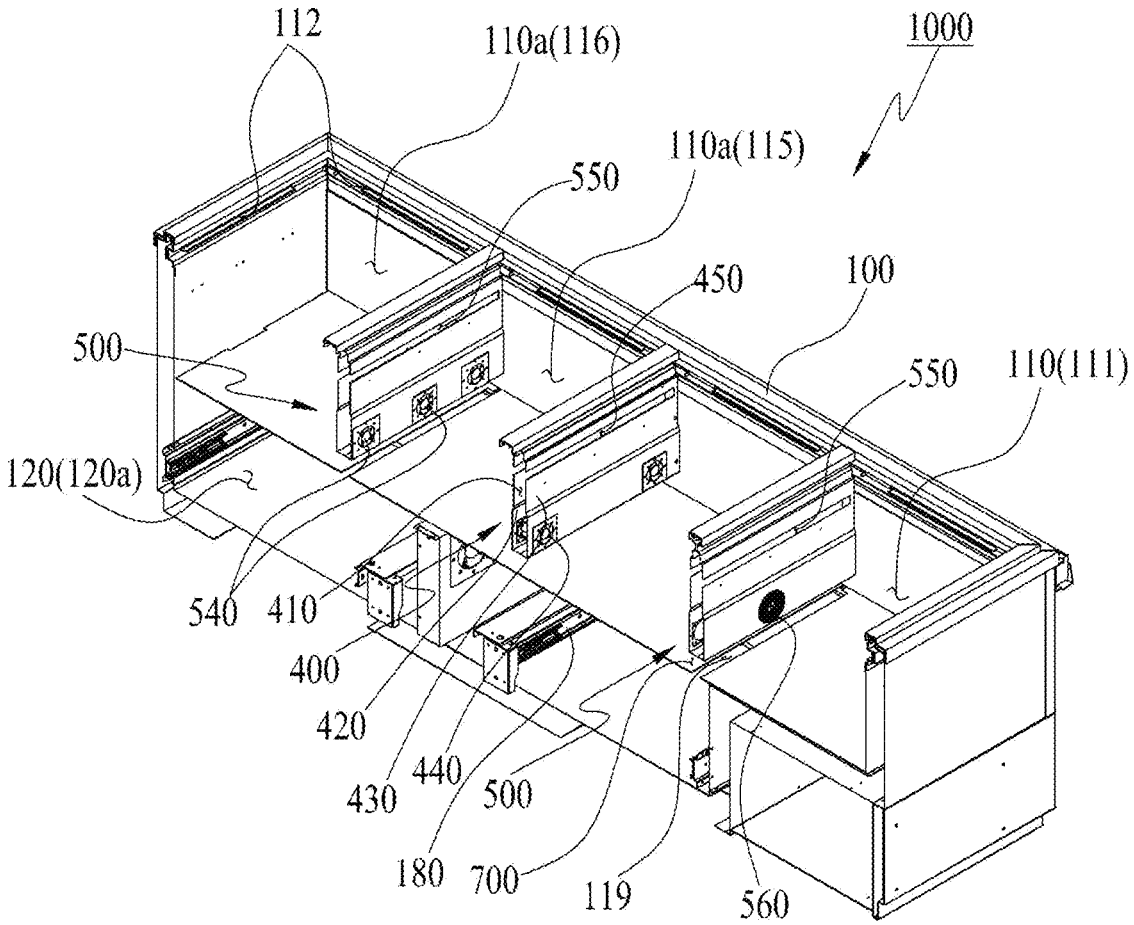
FIG. 2 is a sectional perspective view showing the showcase with a two-story structure according to the present invention.

Further, as shown in FIGS. 2 and 5, the first upper story fan case 400 and the second upper story fan cases 500 are spaced apart from the bottom of the upper story storage chamber 110 to thus form cold air paths 700, and the upper story storage chamber 110 has cold air communication holes 119 extending in front and rear directions from the bottom thereof to face the bottoms of the second upper story fan cases 500 and communicate with the lower story storage chamber 120.

Under the above-mentioned configuration, the cold air introduced into the upper story storage chamber 110 through the cold air communication holes 119 collides against the bottom of each second upper story fan case 500 and is thus dividedly supplied to the first upper story storage chamber 115 and the second upper story storage chamber 116 arranged on both sides of the second upper story fan case 500, so that the cold air circulation between the upper story storage chamber 110 and the lower story storage chamber 120 can be more gently achieved to thus prevent the cold air from being accumulated on any place. Further, air flows are formed in the opposite directions to the flowing directions of the cold air through the first suction fans 440 along the bottom of the upper story storage chamber 110 under the first suction fans 440 disposed on the first upper story fan case 400 in the upper story storage chamber 110, thereby more effectively distributing the cold air on the bottom of the upper story storage chamber 110.

Through the cold air communication holes 119, besides, ascending air flows are generated from the lower story storage chamber 120, thereby reliably preventing the cold air from being accumulated in the lower story storage chamber 120.

When viewed from the front of the showcase 1000, as shown in FIG. 1, the lower story storage chamber 120 extends in left and right directions from one end of the upper story storage chamber 110, and accordingly, the width of the upper story storage chamber 110 is larger than that of the lower story storage chamber 120, thereby locating a machine room M on a stepped space between the upper story storage chamber 110 and the lower story storage chamber 120.

Under the above-mentioned arrangements, space utilization can be more compactly achieved.

According to the present invention, the showcase with a two-story structure is configured to include the body having the upper story storage chamber with the top opening formed on top thereof and the first cold air introduction holes formed on the side surfaces thereof and the lower story storage chamber separately disposed adjacent to the underside of the upper story storage chamber and with the front opening formed on front thereof and the second cold air introduction holes formed on the side surfaces thereof, the upper doors for opening and closing the top opening of the upper story storage chamber, and the drawers for slidingly opening and closing the front opening of the lower story storage chamber, so that the upper story storage chamber and the lower story storage chamber are separated up and down to have different temperatures distributed thereto, thereby sortedly storing a variety of foods or products with different storage characteristics from one another therein, and the front opening of the lower story storage chamber is open and closed by means of the drawers, thereby advantageously ensuring many conveniences of use thereof.

According to the present invention, when viewed from the front of the showcase, the upper story storage chamber is divided into the plurality of upper story sub-storage chambers by means of the first upper story fan case disposed between both transverse ends thereof, and the first upper story fan case includes the pair of first frames facingly located at left and right sides to form the flowing space therebetween, one or more first suction fans located in front and rear directions of the body on the lower portions of the first frames facing both left and right ends of the body and facing the end of the showcase body facing the first frame, and the first exhaust holes piercedly formed on the upper portions of the first frames, respectively, so that cold air, which is blown to the upper story storage chamber via the evaporator and the first cold air introduction holes, sequentially, moves to the bottom of the upper story storage chamber, is then introduced into the flowing space of the first upper story fan case through the first suction fans, while not staying on the bottom of the upper story storage chamber, moves upward, and is thus exhausted to the upper space of the upper story storage chamber through the first exhaust holes to provide the cold air circulation structure, thereby preventing ice in the upper story storage chamber from being produced to thus keep a constant refrigeration temperature and to allow cooling for the foods or products stored to be easily controlled.

According to the present invention, further, the lower story storage chamber is divided into the two lower story sub-storage chambers through the lower story fan case, and through the third suction fans spaced apart from each other in the front and rear directions, cold air circulation between the two lower story sub-storage chambers is performed, so that the cold air is not accumulated on the bottom of the lower story storage chamber, thereby preventing the formation of ice.

According to the present invention, in addition, the upper story storage chamber or one of the upper story sub-storage chambers has the ice cream storage container frame disposed thereon to mount the ice cream storage containers thereonto, and the ice cream storage container frame has the cold air guide holes formed at tops facing the first exhaust holes and the second exhaust holes to move the cold air to the top of the ice cream storage containers, so that the cold air exhausted from the first exhaust hole and the second exhaust hole moves from the top ends of the ice cream storage container frame to ice cream through the cold air guide holes, thereby keeping the cold air on the surface of the ice cream reliably.

According to the present invention, further, the first upper story fan case and the second upper story fan cases are spaced apart from the bottom of the upper story storage chamber to thus form cold air paths, and the upper story storage chamber has cold air communication holes extending in front and rear directions from the bottom thereof to face the bottoms of the second upper story fan cases and communicate with the lower story storage chamber, so that the cold air introduced into the upper story storage chamber through each cold air communication hole collides against the bottom of the second upper story fan case and is thus dividedly supplied to the first upper story storage chamber and the second upper story storage chamber arranged on both sides of the second upper story fan case to provide cold air circulation between the upper story storage chamber and the second storage chamber more gently, thereby preventing the cold air from being accumulated on any place, and the air flows are formed in the opposite directions to the flowing directions of the cold air through the first suction fans along the bottom of the upper story storage chamber under the first suction fans disposed on the first upper story fan case in the upper story storage chamber, thereby more effectively distributing the cold air on the bottom of the upper story storage chamber.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A showcase with a two-story structure comprising:

a body having an upper story storage chamber with a top opening formed on top thereof and first cold air introduction holes formed on the side surfaces thereof and a lower story storage chamber separately disposed adjacent to the underside of the upper story storage chamber and with a front opening formed on front thereof and second cold air introduction holes formed on the side surfaces thereof;

upper doors for opening and closing the top opening of the upper story storage chamber; and drawers for slidingly opening and closing the front opening of the lower story storage chamber.

2. The showcase with a two-story structure according to claim 1, wherein when viewed from the front section thereof, the upper story storage chamber is divided into a plurality of upper story sub-storage chambers by means of a first upper story fan case disposed between both transverse ends thereof, and the first upper story fan case comprises a pair of first frames facingly located at left and right sides to form a flowing space therebetween, one or more first suction fans located in front and rear directions of the body on the lower portions of the first frames facing both left and right ends of the body and facing the end of the showcase body facing the first frame, and first exhaust holes piercedly formed on the upper portions of the first frames, respectively.

3. The showcase with a two-story structure according to claim 2, wherein each first exhaust hole has the shape of a long hole extending in front and rear directions.

4. The showcase with a two-story structure according to claim 2, wherein when viewed from the front section thereof, the upper story sub-storage chambers are dividedly disposed between the first upper story fan case and at least one of both left and right ends of the body by means of second upper story fan cases, and the second upper story fan case comprises a pair of second frames facingly located at left and right sides to form a flowing space therebetween, a plurality of second suction fans located in front and rear directions of the body on the lower portions of the second frames facing the first upper story fan case and facing the first frame, second exhaust holes piercedly formed on the upper portions of the second frames, respectively, and a first outlet formed at a position facing at least one of the second suction fans disposed in the front and rear directions on the lower portions of the second frames where no second suction fans are disposed.

5. The showcase with a two-story structure according to claim 1, wherein when viewed from the front thereof, the lower story storage chamber is divided into a plurality of lower story sub-storage chambers by means of a lower story fan case disposed between both transverse ends thereof, the lower story sub-storage chambers being open and closed by means of the drawers, respectively.

6. The showcase with a two-story structure according to claim 5, wherein rail members for guiding the movements of the drawers on both sides with the lower story fan case interposed therebetween are spaced apart.

7. The showcase with a two-story structure according to claim 4, wherein the upper story storage chamber or one of the upper story sub-storage chambers has an ice cream storage container frame disposed thereon to mount ice cream storage containers thereonto, and the ice cream storage container frame has cold air guide holes formed at tops facing the first exhaust holes and the second exhaust holes to move the cold air to the top of the ice cream storage containers.

8. The showcase with a two-story structure according to claim 1, wherein the lower story storage chamber extends in left and right directions from one end of the upper story storage chamber, and the width of the upper story storage chamber is larger than the width of the lower story storage chamber to allow a machine room to be located on a stepped space between the upper story storage chamber and the lower story storage chamber.

* * * * *